US006290350B1

(12) United States Patent
Kono

(10) Patent No.: US 6,290,350 B1
(45) **Date of Patent: *Sep. 18, 2001**

(54) IMAGE FORMING APPARATUS HAVING SUPPORT MEANS FOR SUPPORTING DISCHARGED SHEETS

(75) Inventor: Takeshi Kono, Kawasaki (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/075,216

(22) Filed: May 11, 1998

(30) Foreign Application Priority Data

May 15, 1997 (JP) ..... 9-125309

(51) Int. Cl.[7] ..... B41J 2/01
(52) U.S. Cl. ..... 347/104
(58) Field of Search ..... 271/10.09, 113, 271/264; 400/624, 625; 347/104, 105

(56) References Cited

U.S. PATENT DOCUMENTS 4,794,859 1/1989 Huseby et al. .
4,844,633 7/1989 Greenberg .
5,226,743 * 7/1993 Jackson et al. ..... 347/104
5,536,000 7/1996 Kelly .
5,603,493 2/1997 Kelly .
5,927,877 * 7/1999 Kelly et al. ..... 347/104

FOREIGN PATENT DOCUMENTS 0 530 821 3/1993 (EP) .
0 792 751 9/1997 (EP) .

* cited by examiner

*Primary Examiner*—Arthur T. Grimley
*Assistant Examiner*—Hoang Ngo
(74) *Attorney, Agent, or Firm*—Fitzpatrick, Cella, Harper & Scinto

(57) ABSTRACT

The present invention provides an image forming apparatus includes a recording head to record an image on a sheet and having a carriage for shifting the recording head in a sheet width-wise direction, a convey rotary member for conveying the sheet past the recording head and for discharging the sheet after recording, a support for supporting one surface of the sheet, and a shift device for shifting the support between a support position where the sheet is supported above a discharge portion and a retard position where the sheet is not supported by the support. The shift device is switched in accordance with a position of the carriage and has a transmission for effecting ON/OFF of a driving force for rotating the convey rotary member.

14 Claims, 10 Drawing Sheets

IMAGE FORMING APPARATUS HAVING SUPPORT MEANS FOR SUPPORTING DISCHARGED SHEETS

BACKGROUND OF THE INVENTION

1. Field of the Invention

The present invention relates to an image forming apparatus such as a printer, a copying machine and the like. More particularly, it relates to an image forming apparatus in which a sheet is discharged onto a discharge portion after the sheet is temporarily held.

2. Related Background Art

In conventional image forming apparatuses, generally, a sheet on which an image is recorded by a recording means is discharged onto a discharge portion immediately after recording. Such an arrangement has widely been used in image forming apparatuses of the ink jet recording system which have recently been popularized.

In the ink jet recording system, the recording is effected by discharging ink droplets. Regarding recording density of normal recording such as a standard document or a table, there is no problem, but, when recording density is great (such as color recording), a time period sufficient to fix the ink is required. In a color image forming apparatus, if an image forming speed is increased, before the ink is fixed to the sheet discharged on the discharge portion, a next sheet is discharged onto a discharge portion. As the result, the imaged surface of the preceding sheet discharged on the discharge portion is rubbed by a tip end or a back surface of the next sheet, thereby distorting the recorded image.

To avoid this problem, a technique for promoting the drying of ink by using heat from an infrared ray heater has been proposed. However, when the infrared ray heater is used, the entire apparatus is made complicated and expensive. Thus, a technique not using the heater has also been proposed.

For example, as shown in FIG. 11, a pair of opposed and spaced side rail members 50*a,* 50*b* are supported for rotation around respective pivot points 51*a,* 51*b.* Further, vertical walls 52*a,* 52*b* are provided with recessed portions 53*a,* 53*b* through which the side rail members 50*a,* 50*b* are rotated in directions shown by the arrows X.

With the arrangement as mentioned above, a recorded sheet S is conveyed by a convey means (not shown) in a direction perpendicular to the plane of FIG. 11.

At this point, as shown in FIG. 11, the side rail members 50*a,* 50*b* are held in a closed position so that they can support the sheet S and hold the sheet above a discharge portion 54*a* of a discharge tray 54. When the sheet S is discharged, the side rail members 50*a,* 50*b* are rotated in the directions X to an open position where the side rail members do not interfere with the sheet S, thereby permitting the dropping of the sheet onto the discharge portion 54*a*.

In this way, the ink image recorded on the sheet S rested on the discharge portion 54*a* is dried while the image is being recorded on the succeeding sheet, thereby preventing deterioration of the recorded image.

However, in the above-mentioned technique, since the operation of the side rails must be synchronized with the sheet conveying operation, the mechanism may be made complicated. And, if a drive source such as a motor for achieving the synchronism is added, the entire apparatus will be made more expensive.

SUMMARY OF THE INVENTION

The present invention aims to eliminate the above-mentioned conventional drawbacks, and an object of the present invention is to provide an image forming apparatus in which ink contamination and distortion of an imaged surface of a discharged sheet can be prevented with a simple construction, without worsening sheet discharging and stacking ability and without making an entire apparatus bulky and expensive.

To achieve the above object, there is provided an image forming apparatus comprising a recording means adapted to record an image on a sheet and having a carriage for shifting the recording means in a sheet width-wise direction, a convey rotary means for conveying the sheet through the recording means and for discharging the sheet after recording, a support means for supporting one surface of the sheet, and a shift means for shifting the support means between a support position where the sheet is supported above a discharge portion and a retard position where the sheet is not supported by the support means. The shift means is switched in accordance with a position of the carriage and has a transmission means for effecting ON/OFF of a driving force for rotating the convey rotary means.

With the arrangement as mentioned above, by supporting the discharged sheet by means of the support means, a succeeding sheet being discharged can be prevented from rubbing a recorded surface of a preceding sheet already discharged on the discharge portion, thereby preventing ink contamination and distortion of the recorded image.

Further, by shifting the support means by the shifting movement of the carriage and the drive source for sheet conveyance, the sheet can be supported and released with a simple construction, without adding any new drive source.

DETAILED DESCRIPTION OF PREFERRED EMBODIMENTS

The present invention will now be fully explained in connection with embodiments thereof with reference to the accompanying drawings.

[First Embodiment]

Figure 1:
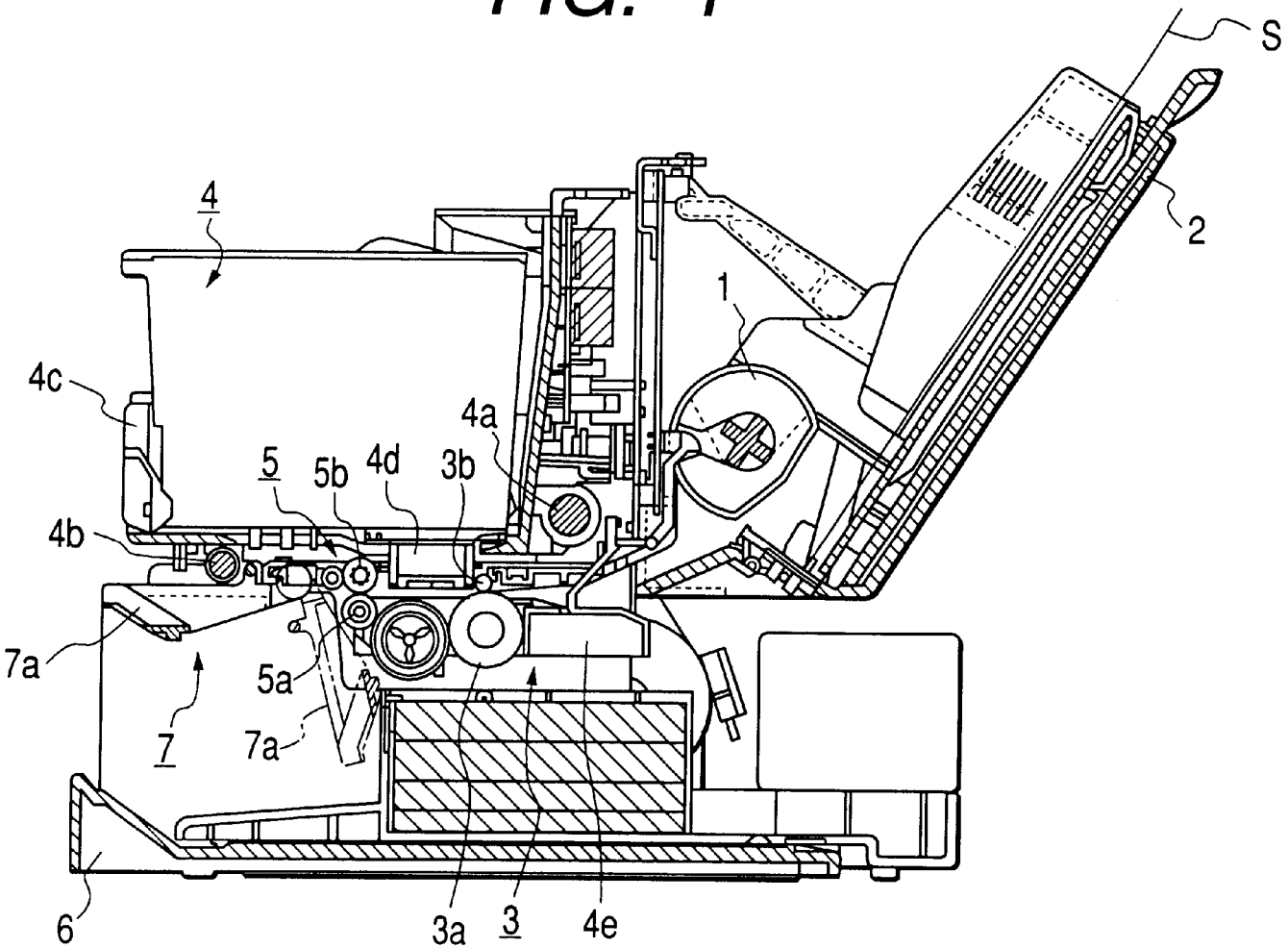
FIG. 1 is an explanatory view showing an entire construction of an image forming apparatus according to the present invention.

A first embodiment of the present invention will be described with reference to FIGS. 1 to 4, 5A and 5B, and 6 to 10. FIG. 1 is an explanatory view showing an entire construction of an image forming apparatus according to the first embodiment of the present invention, and FIGS. 2 to 4, 5A and 5B, and 6 to 10 are explanatory views for explaining a function and an operation of a sheet support means.

(Entire Construction of Image Forming Apparatus)

First of all, explaining an entire construction of the image forming apparatus, a sheet supply roller 1 rotatingly driven by a drive means (described later) cooperates with a separation pawl (not shown) to separate and supply sheets S rested on a sheet supply tray 2 one by one from an uppermost one.

The supplied sheet S is conveyed to a recording position by a drive convey roller 3*a,* and a driven roller 3*b* for urging the sheet S against the convey roller, which rollers 3*a,* 3*b* constitute a convey means 3.

In the illustrated embodiment, a recording means 4 serves to record an ink image on the sheet S (conveyed by the convey means) by utilizing an ink jet recording system. More specifically, a recording head 4*d* is mounted on a carriage 4*c* reciprocally shifted along a guide shaft 4*a* and a guide rail 4*b* which extend in a width-wise direction of the recording sheet S. And, the recording head 4*d* is driven in synchronously with the reciprocal movement of the carriage 4*c* so that ink droplets are discharged, in response to image signals, toward the sheet S supported by a platen 4*e* at its rear surface, thereby recording an ink image.

The recording head 4*d* includes fine liquid discharge openings (orifices), liquid passages, energy acting portions disposed within the respective liquid passages, and energy generating means for generating liquid droplet generating energy acting on the liquid in the acting portions.

A recording method using such energy generating means may be a recording method using electrical/mechanical converters such as piezo-electric elements, a recording method using energy generating means for generating electromagnetic waves such as a laser onto liquid to heat the liquid, thereby discharging liquid droplets under the action of the heating, or a recording method using energy generating means for heating liquid by electrical/thermal converters such as heat generating elements having heat generating resistance bodies to discharge the liquid.

Among these recording methods, in recording heads used in the ink jet recording method for discharging ink by thermal energy, since the liquid discharge openings (orifices) for discharging recording liquid droplets can be arranged at high density, recording with high resolving power can be permitted. Among them, a recording head using electrical/thermal converters as the energy generating means is advantageous since it can easily be made compact, can easily be arranged at high density and can be made more cheaply.

In the illustrated embodiment, as the ink discharging arrangement, the electrical/thermal converter is energized in response to a record signal, and ink is discharged from the discharge opening due to growth and contraction of a bubble created in the ink by film-boiling of the ink caused by the thermal energy from the electrical/thermal converter, thereby effecting the recording.

In the illustrated embodiment, an ink tank for storing the ink is integrally attached to the recording head 4*d* at the top thereof to form a cartridge which is in turn detachably mounted on the carriage 4*c*.

A discharge means 5 includes a drive discharge roller 5*a* (receiving a force from the roller 3*a* via a friction roller), and a driven spur roller 5*b* for urging the sheet S against the discharge roller and serves to discharge the sheet S (after recording) onto a discharge tray (discharge portion) 6 with an imaged surface facing upwardly. The spur roller is a rotary member having a small contact area (with the sheet S) so that, even when it is contacted with the ink imaged surface of the sheet, the ink image is not distorted.

Regarding the sheet S discharged out of the apparatus by means of the discharge means 5, when the image is recorded on a rear part (in a sheet conveying direction) of the sheet, since the sheet is supported only by the platen 4*e* opposed to the recording head 4*d,* a tip end of the sheet starts to be suspended by its own weight. If the sheet continues to be discharged as it is, the suspended tip end of the sheet will rub the ink imaged surface of the previously discharged sheet. To avoid this, in the illustrated embodiment, the sheet is supported by a support means 7 before the sheet is discharged on the discharge tray 6 to prevent the tip end of the sheet conveyed and discharged by the discharge means 5 from being suspended.

(Support Means)

Figure 2:
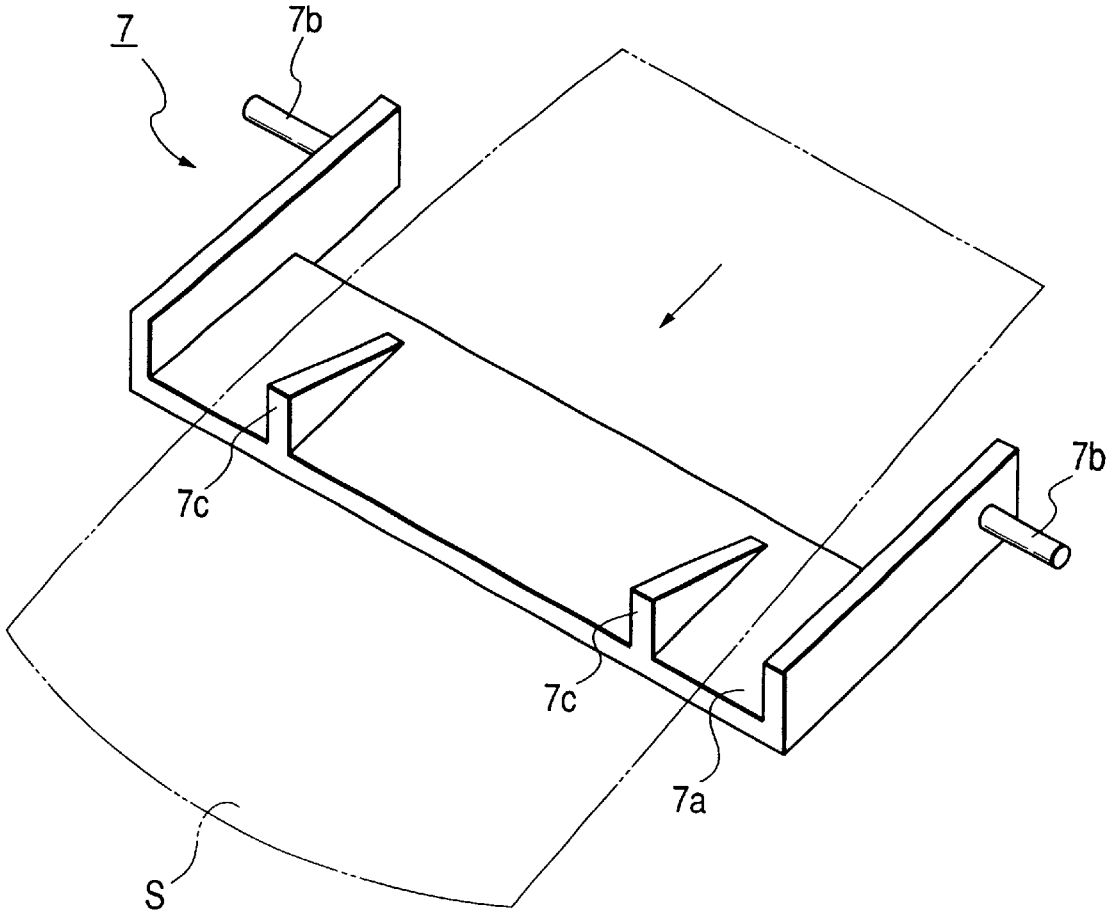
FIG. 2 is a perspective view for explaining a support means.

Now, the support means 7 will be described. As shown in FIGS. 1 and 2, the support means 7 is arranged above the discharge tray 6 and includes a plate-shaped support member 7*a* disposed at a downstream side of the discharge means 5 in the sheet conveying direction and adapted to support a non-image surface of the sheet S through the entire width-wise direction of the sheet. As shown in FIG. 2 (perspective view of the support means), the support member 7*a* can be rotated around a shaft 7*b* of a main body of the apparatus transverse to a sheet discharging direction. The support member is rotated by a drive transmitting means (described later) between a support position shown by the solid line in FIG. 1 and a retard position shown by the two dot and chain line. As will be described later, when the support member is in the support position, it supports the rear surface of the sheet discharged from the discharge means 5, and, when the support member is in the retard position, the sheet is not supported by the support member.

Figure 3:
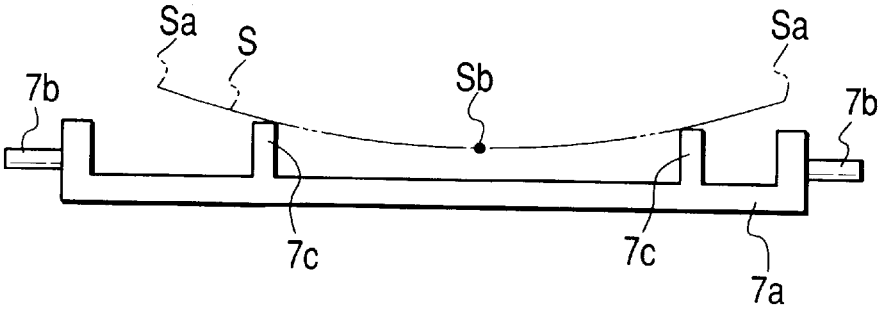
FIG. 3 is a schematic view of the support means, viewed from a sheet discharging direction.

As shown in FIG. 2, a sheet supporting surface of the support member 7*a* is provided with two spaced support ribs 7*c* protruded therefrom. The ribs 7*c* are gradually protruded from the sheet supporting surface toward the sheet discharging direction so that, when the sheet S is discharged in a condition that the support member 7*a* is positioned at the support position, the sheet S is discharged while riding on the ribs 7*c*. In this case, the sheet S is supported by the ribs 7*c* so that, as shown in FIG. 3 (schematic view of the support means, viewed from the sheet discharging direction), along the sheet conveying direction, a central portion Sb of the sheet in the sheet width-wise direction is curved downwardly (concave) in comparison with both end portions Sa. Thus, rigidity (resiliency) of the recording sheet S is increased to prevent suspension of the sheet (Incidentally, the sheet may be curved upwardly (convex)).

(Drive Arrangement of Support Means)

Figure 4:
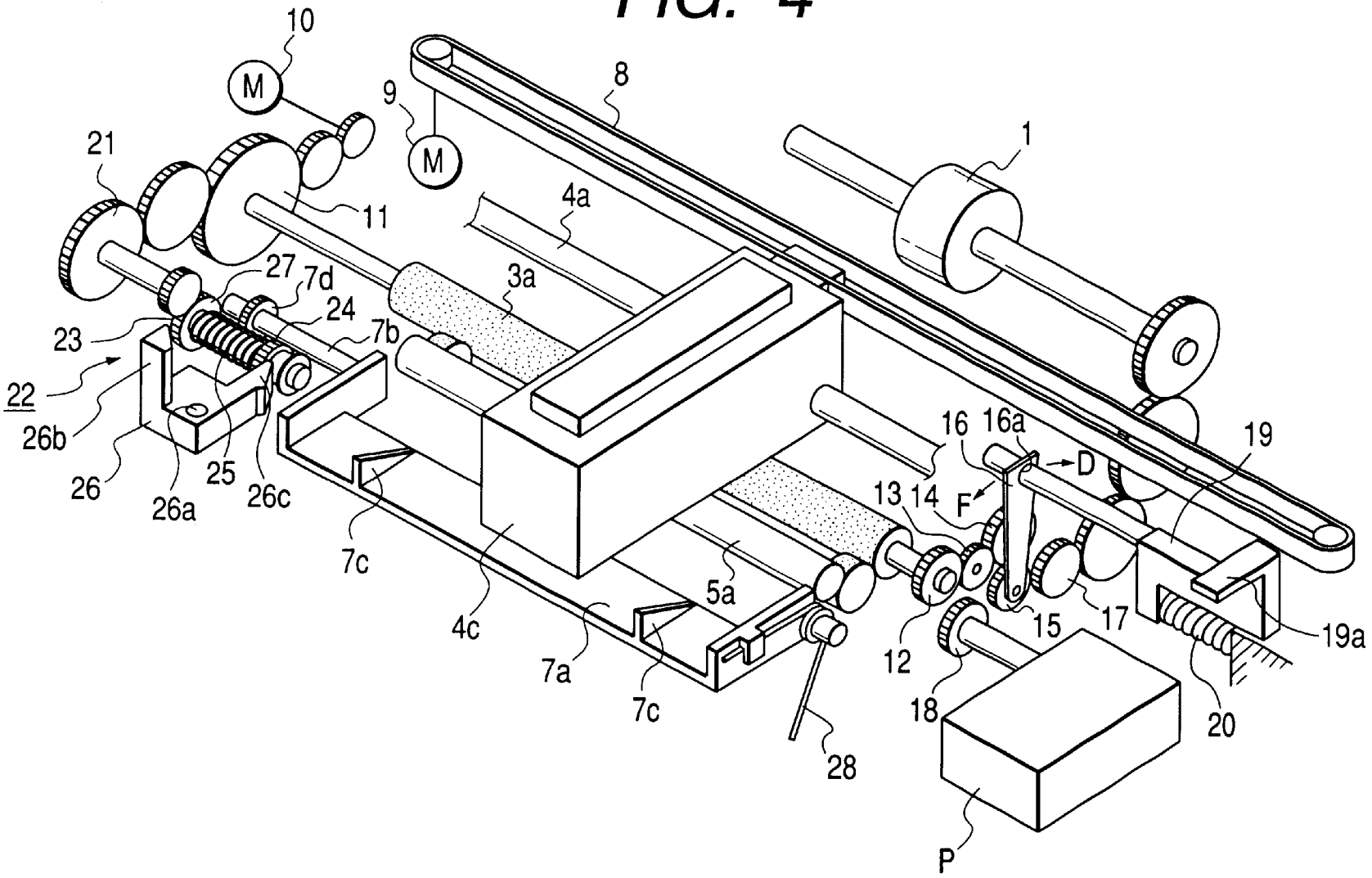
FIG. 4 is an explanatory view showing a drive transmitting arrangement.

Now, the drive arrangement of the support means will be described. In the illustrated embodiment, as shown in FIG. 4, there are provided two drive sources, i.e., a carriage motor 9 for reciprocally shifting the carriage 4*c* via a belt 8 in the width-wise direction, and a convey motor 10 for rotating the convey roller 3*a* (for conveying the sheet S) via a gear train.

The driving operations include the recording of the ink image, the driving of the sheet supply roller 1, the driving of a pump unit P and the driving of the support member 7*a,* and such driving operations are controlled only by the carriage motor 9 and the convey motor 10.

In order to effect the recording of the ink image, the carriage motor 9 and the convey motor 10 are driven to synchronize the reciprocal shifting movement of the carriage with the rotation of the convey roller 3*a* as mentioned above.

Next, the driving of the sheet supply roller 1 and the driving of the pump unit P will be described. As shown in FIG. 4, a gear 11 for receiving power from the convey motor 10 is secured to one shaft end of the convey roller 3*a,* and a gear 12 is secured to the other shaft end. The gear 12 is meshed with a gear 13 to transmit the driving force of the convey motor 10.

The gear 13 is meshed with a next gear 14 which is a sun gear, and a planetary gear 15 revolved around the gear 14 is attached to a shaft of an arm 16 rotatable coaxially with the gear 14, so that the power is transmitted from the sun gear 14 to the planetary gear 15. The sun gear 14 is rotated in the same direction as the convey roller 3*a.* The planetary gear 15 is urged against the arm 16 by a spring so that the arm 16 is subjected to a predetermined rotational load from the planetary gear 15.

When the gear 14 is rotated in the sheet conveying direction F by driving the convey motor 10, due to the rotational load, the planetary gear 15 is fixed with respect to the arm 16 to include arm 16 in the direction F by the rotation of the gear 14. As a result, the planetary gear 15 is meshed with a gear 17 (adjacent to the gear 14) for transmitting the driving force, thereby transmitting the power of the convey motor 10 to the sheet supply roller 1.

Similarly, when the gear 14 is rotated in a direction D opposite to the sheet conveying direction, the arm 16 is rotated in the direction D, with the result that the power can be transmitted to a gear 18 for driving the pump unit P. If the ink discharge opening(s) of the recording head 4*d* are clogged, the pump unit P serves to absorb the ink from the discharge opening(s) by a pump, thereby eliminating the clogging.

The arm 16 is provided with a hole 16*a* through which a bar 19 can be inserted. In a condition that the bar 19 is inserted into the hole 16*a,* the rotation of the arm 16 is regulated so that the gear 15 is not contacted with both the gear 17 and the gear 18. As a result, even when the gear 14 is rotated in the direction F or D by driving the convey motor 10, the sheet supply roller 1 and the pump unit P are not driven.

The bar 19 can be slid in the same direction of the carriage 4*c* and is biased toward a center of the apparatus by a spring 20. The bar 19 is slid integrally with a rib 19*a* which is urged by the carriage 4*c* only when the carriage 4*c* is shifted to the vicinity of a right (FIG. 4) end of the apparatus. Thus, when the carriage 4*c* is at the right end of the apparatus, the bar 19 is disengaged from the hole 16*a* of the arm 16. In this condition, when the convey motor is driven, as mentioned above, the sheet supply roller 1 and the pump unit P can be driven.

Figure 5A:
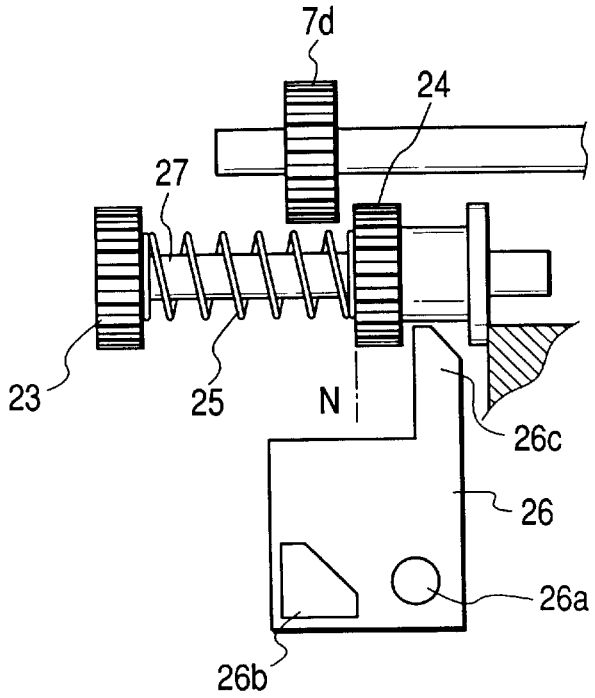
FIGS. 5A and 5B are views for explaining a driving force transmission switching arrangement for the support means.
Figure 5B:
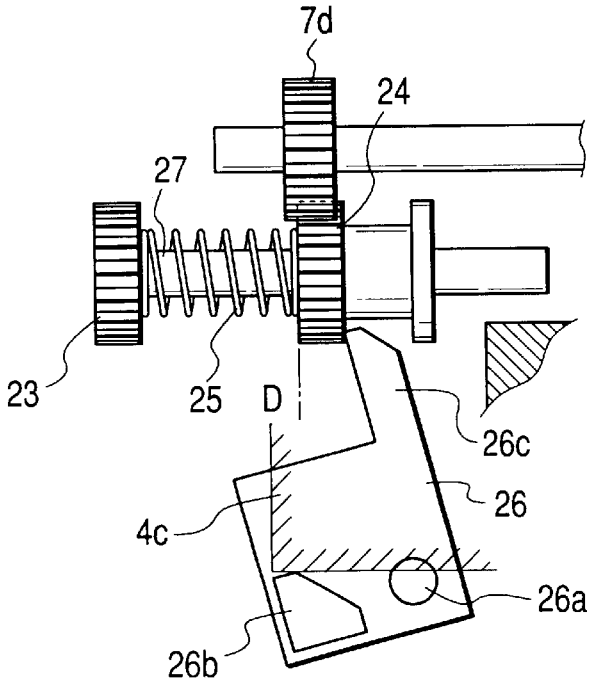

Next, the drive arrangement of the support means 7 will be described. As shown in FIG. 4, there are provided a gear train 21 for transmitting the power from the convey motor 10 to the support means 7, and a switching portion 22 for switching transmission and non-transmission of the power. As shown in FIGS. 5A and 5B, the switch portion 22 includes an input gear 23 for receiving the power from the convey motor 10, a slide gear 24 coaxial with the input gear 23 and slidable axially, a spring 25 for applying lateral pressure to the slide gear 24, a gear 7*d* secured to a rotary shaft 7*b* of the support member 7*a,* and a lever 26 for sliding the slide gear 24.

The input gear 23 is secured to a shaft 27, and the slide gear 24 is rotatably supported on the shaft 27 so that it can be slid along the shaft 27 between a position D (FIG. 5B) where the slide gear is engaged by the gear 7*d* of the support member 7*a* and a position N (FIG. 5A) where slide gear is not engaged by the gear 7*d.* The shaft 27 of the input gear 23 is connected to a hole (not shown) of the slide gear 24 in a key-way fashion so that the slide gear can be shifted between the positions D and N and the rotation of the input gear 23 is always transmitted to the slide gear 24.

The spring 25 is disposed between the input gear 23 and the slide gear 24 to bias these elements away from each other. Thus, in a normal condition, due to a spring force of the spring 25, the slide gear 24 is biased to the slide position N. The lever 26 is rotatably supported on a shaft 26*a* of the main body of the apparatus and is abutted against the carriage 4*c* only when the carriage 4*c* is shifted to the vicinity of a left (FIG. 4) end of the apparatus. The lever has a projection 26*b* for applying a rotational force to the lever 26, and a lever tip end portion 26*c* for urging a side surface of the slide gear 24 toward the slide position D in response to the rotation.

As shown in FIG. 5B, when the carriage 4*c* is shifted to the vicinity of the left end of the apparatus, the projection 26*b* is urged by the carriage 4*c* to rotate the lever 26, with the result that the slide gear 24 urged by the lever tip end portion 26*c* is shifted to the slide position D to be engaged by the gear 7*d.* In this case, the support member 7*a* is normally held at the support position by a torsion coil spring 28. In the condition that the slide gear 24 is positioned at the slide position D, when the convey motor 10 is rotated in the sheet conveying direction, the support member is rotated to the retard position. When the carriage 4*c* is shifted from the left end of the apparatus, since the urging of the lever 26 is released, the slide gear 24 is slid to the position N shown in FIG. 5A by the biasing force of the spring 25 to be disengaged from the gear 7*d,* and the support member 7*a* is returned to the support position by the biasing force of the spring 28.

Next, the operation from the supply to the discharge of the sheet will be explained. First of all, after the carriage 4*c* is shifted to the right end of the apparatus by driving the carriage motor 9, the convey motor 10 is rotated in the sheet conveying direction (direction F in FIG. 4). Consequently, as mentioned above, the planetary gear 15 is revolved around the sun gear 14 to rotate the arm 16, with the result that the planetary gear 15 is engaged by the gear 17 to transmit the driving force, thereby rotating the sheet supply roller to separate and supply the single sheet S from the sheet supply tray 2.

When the sheet supply roller 1 is rotated by a predetermined amount (amount required to bring the sheet S to the convey roller 3*a*), the convey motor 10 is rotated reversely until the planetary gear 15 is positioned between the gear 17 and the gear 18, and, the carriage motor 9 is driven to separate the carriage 4*c* from the right end of the apparatus. Consequently, the bar 19 is inserted into the hole 16*a* of the arm 16 to prevent the rotation of the arm. Thus, when the convey motor 10 is rotated, only the convey roller 3*a* is rotated.

Figure 6:
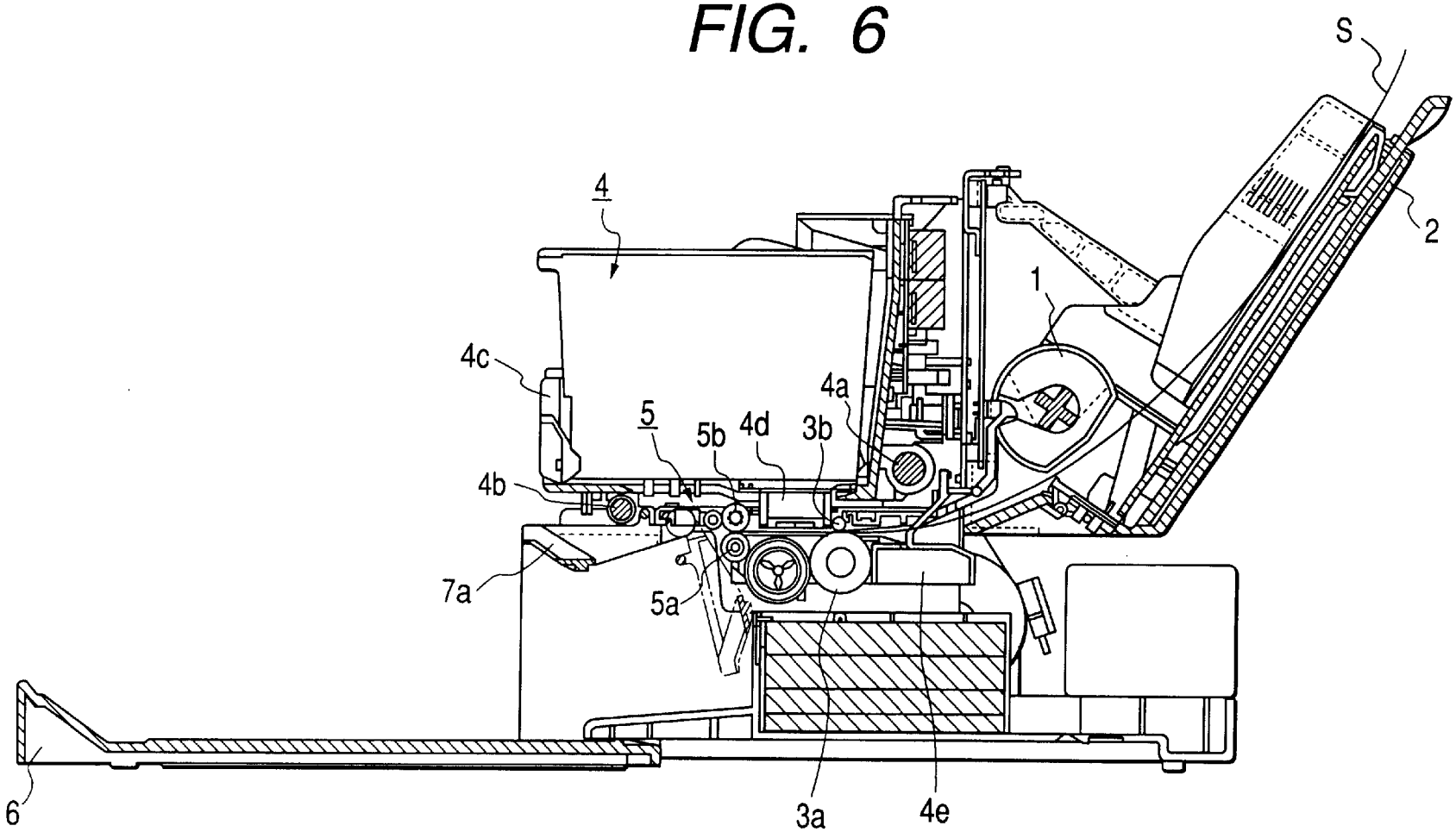
FIG. 6 is an explanatory view showing a condition that recording on a sheet is started, in an image forming apparatus according to a first embodiment of the present invention.
Figure 7:
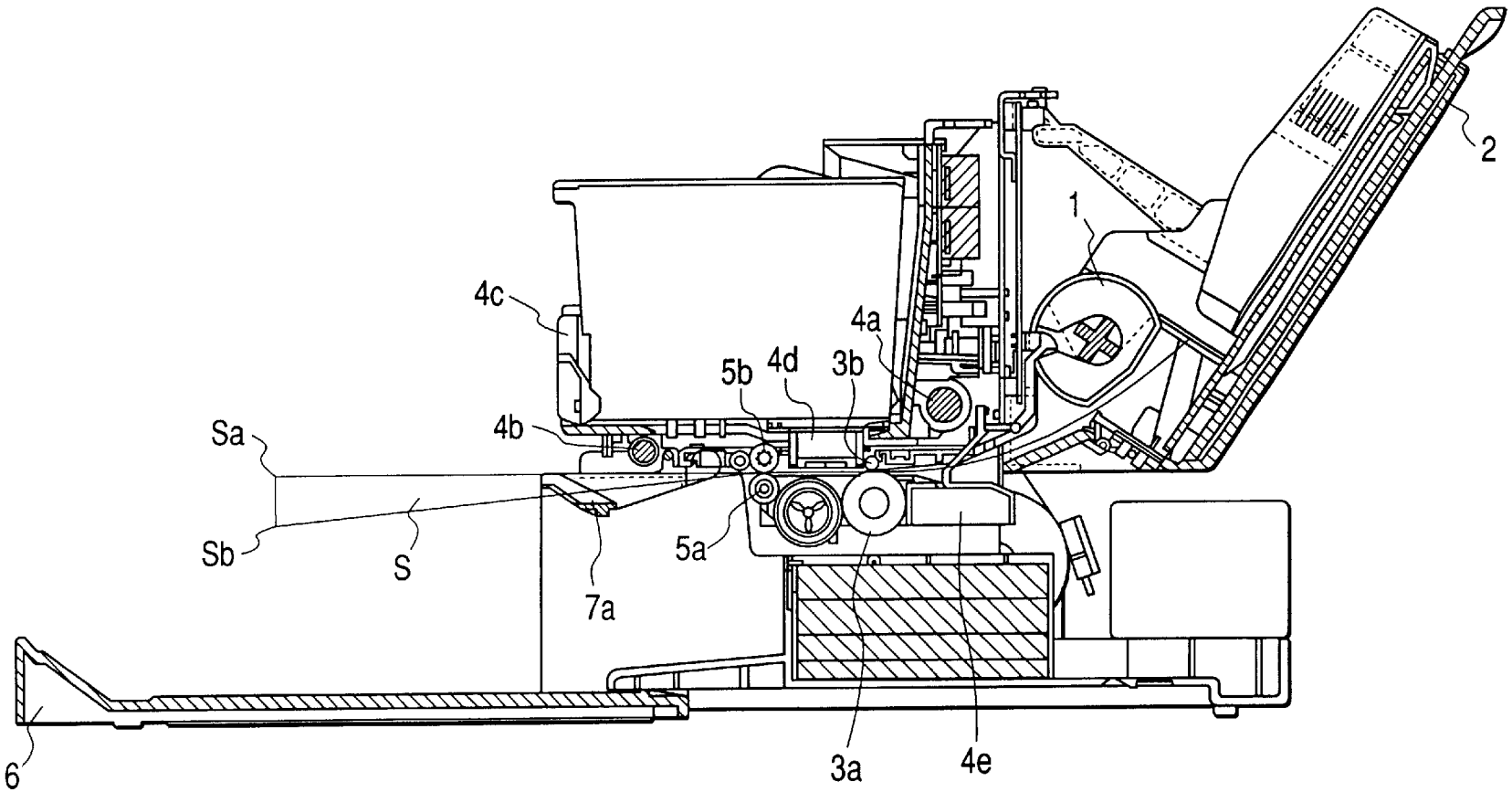
FIG. 7 is an explanatory view showing a condition that the sheet starts to be discharged, in the image forming apparatus according to the first embodiment.
Figure 8:
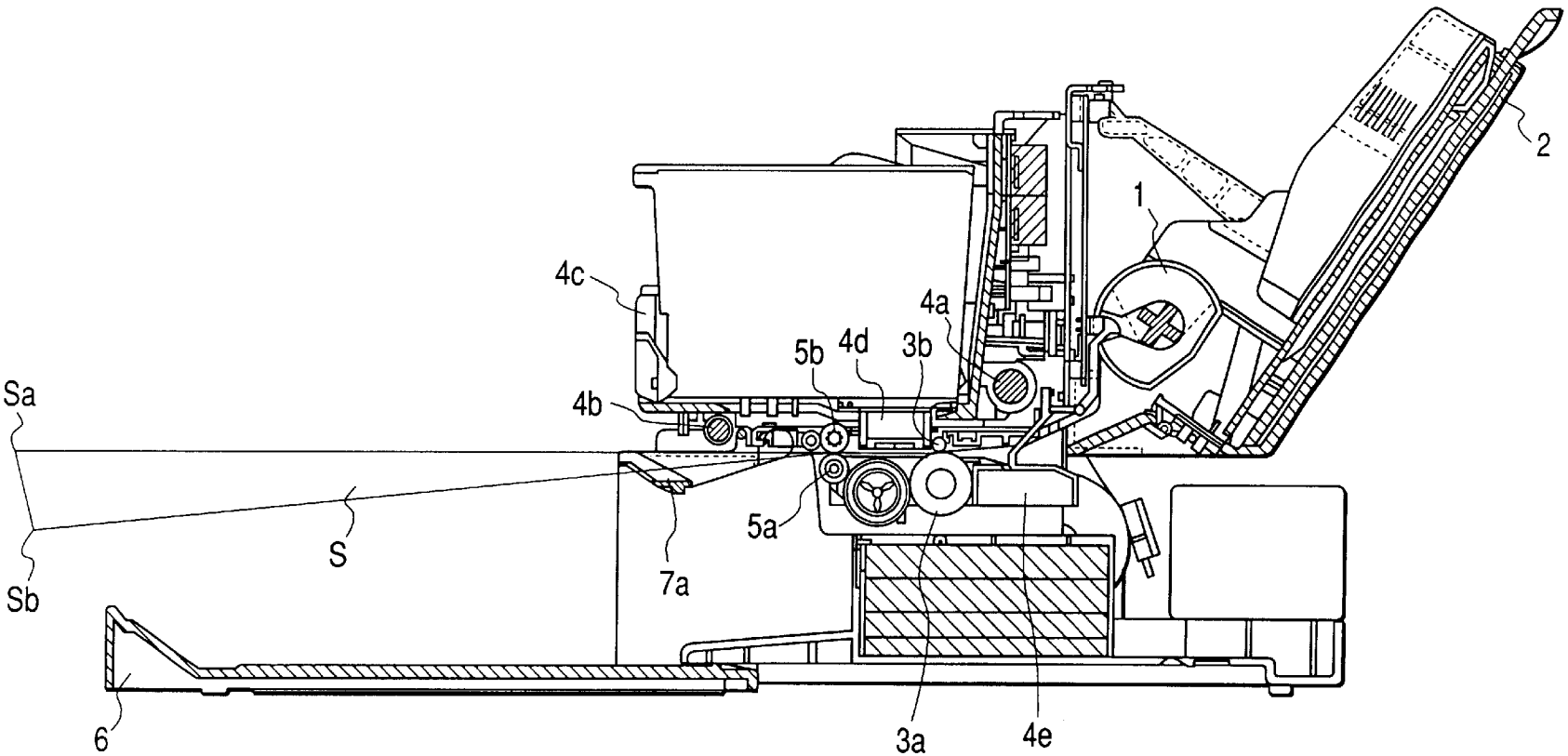
FIG. 8 is an explanatory view showing a condition that the sheet is further discharged, in the image forming apparatus according to the first embodiment.

In this condition, the carriage motor 9 and the convey motor 10 and the recording head 4*d* are operated synchronously with each other to form the ink image. During the image formation, as shown in FIG. 6, the support member 7*a* is positioned at the support position, and the sheet S on which the ink image was recorded is gradually discharged out of the apparatus by the discharge roller 5 driven by the convey roller 3*a* in the same direction. As shown in FIG. 7, the rear surface (opposite to the imaged surface) of the sheet S is supported by the support member 7*a*. In this case, as mentioned above, the sheet S rides on the ribs 7*c* to be curved downwardly in the sheet width-wise direction, with the result that the sheet is supported in a condition that the central portion Sb is positioned below the both ends Sa as shown in FIGS. 7 and 8. Thus, as mentioned above, the rigidity of the sheet is increased, the sheet is supported by the support member 7*a* without being suspended even after the recording is finished.

Figure 9:
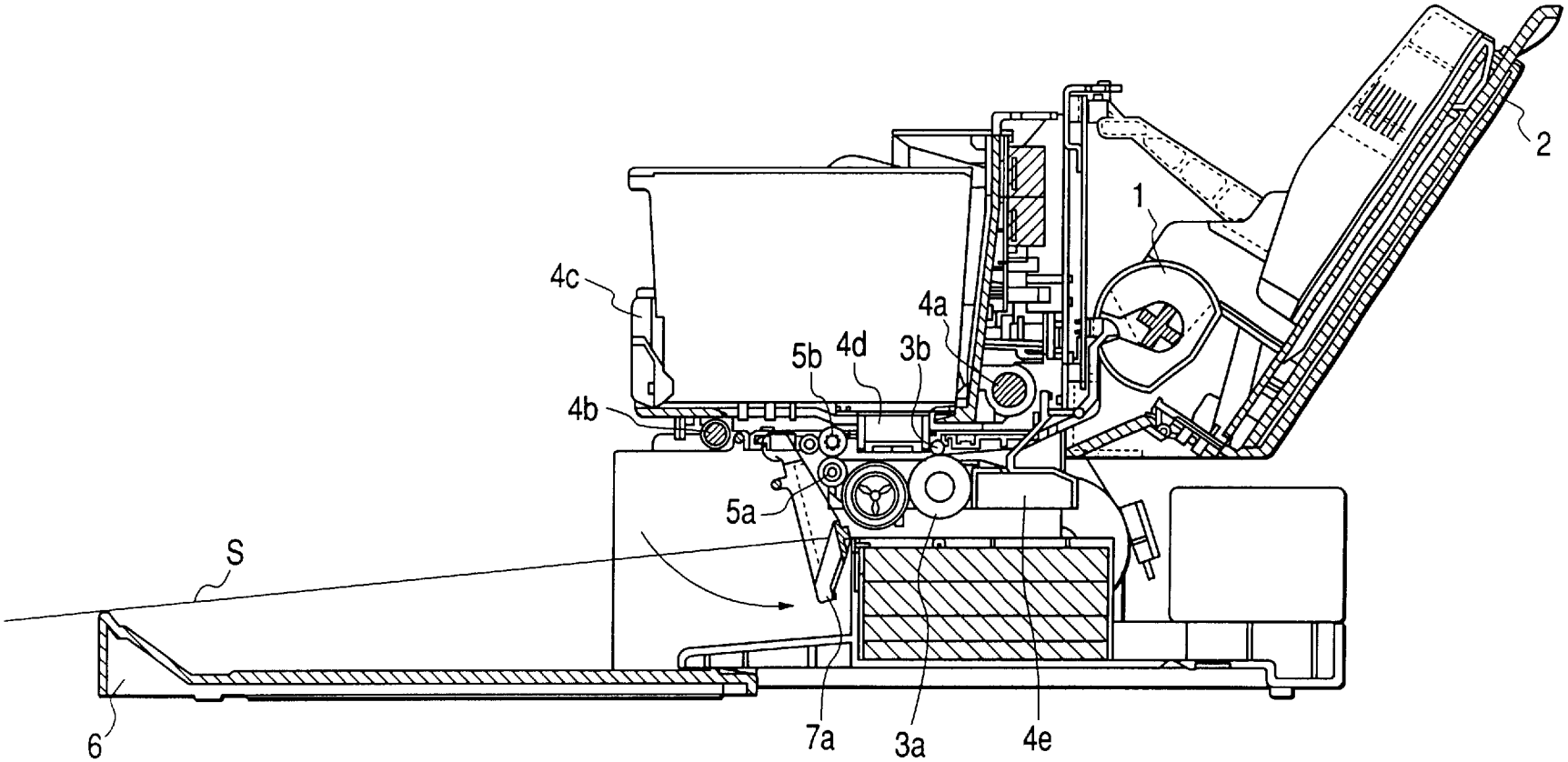
FIG. 9 is an explanatory view showing a condition that the sheet is discharged onto a discharge tray, in the image forming apparatus according to the first embodiment.

After the sheet is discharged by the discharge roller 5, the carriage motor 9 is driven to shift the carriage 4*c* to the left end of the apparatus, and the convey motor 10 is rotated in the conveying direction by the predetermined amount. Consequently, as mentioned above, the projection 26*b* of the lever 26 is urged by the carriage 4*c* to rotate the lever 26, thereby engaging the slide gear 24 with the gear 7*d*. In this condition, when the convey motor 10 is driven, the driving force is transmitted to the shaft 7*b* to rotate the support member 7*a* in the direction shown by the arrow, thereby bringing the support member to the retard position as shown in FIG. 9.

Since the supporting of the rear surface of the sheet S is released, the sheet is dropped onto the discharge tray 6.

Figure 10:
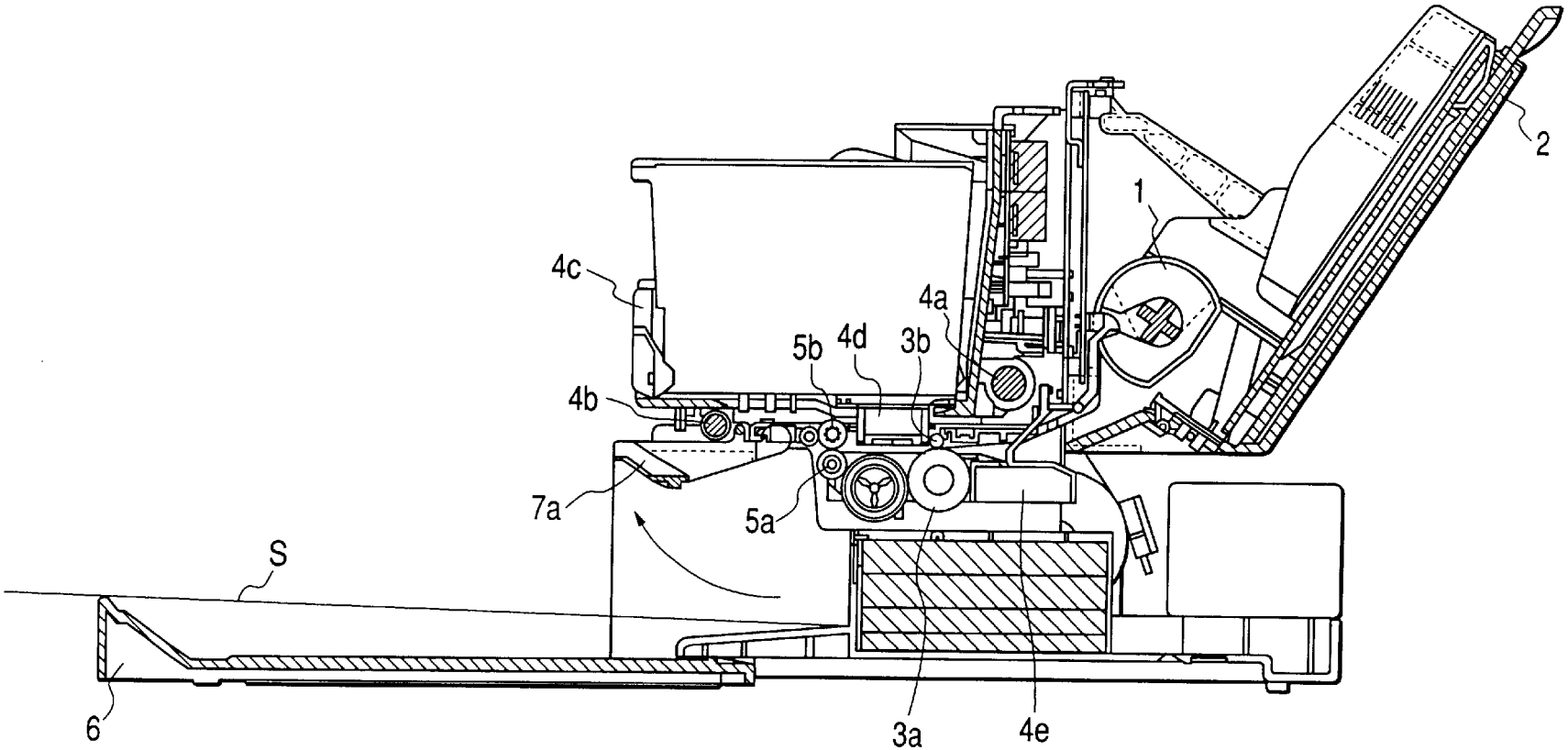
FIG. 10 is an explanatory view showing a condition that the support member is returned to its waiting position after the sheet was discharged on the discharge tray, in the image forming apparatus according to the first embodiment.

Thereafter, when the carriage 4*c* is separated from the left end of the apparatus by driving the carriage motor 9, as shown in FIG. 10, the support member 7*a* is returned to the support position by the action of the spring 28 (FIG. 4) for preparing for the discharge of a next sheet S. In this case, if the suction of the recording head 4*d* is required, the carriage motor 9 is driven to shift the carriage 4*c* to the right end of the apparatus, and, then, the convey motor 10 is shifted to the direction D opposite to the sheet conveying direction. Then, the pump unit P is driven. When the predetermined amount required for pumping operation is achieved, the convey motor 10 is rotated normally until the planetary gear 15 is positioned between the gear 17 and the gear 18, and the carriage motor 9 is driven to separate the carriage 4*c* from the right end of the apparatus. As a result, the waiting condition is restored again.

As mentioned above, by effecting the control by using the combination of the shifting movement of the carriage and the sheet conveyance, the support member can be driven without adding any motor and without affecting a bad influence upon other operations (driving of the sheet supply roller, driving of the pump unit, formation of the ink image and the like). Further, since the support member 7*a* can be shifted to the retard position while the sheet S is being discharged by the discharge roller, the time can be saved and the sheet can be discharged positively.

Figure 11:
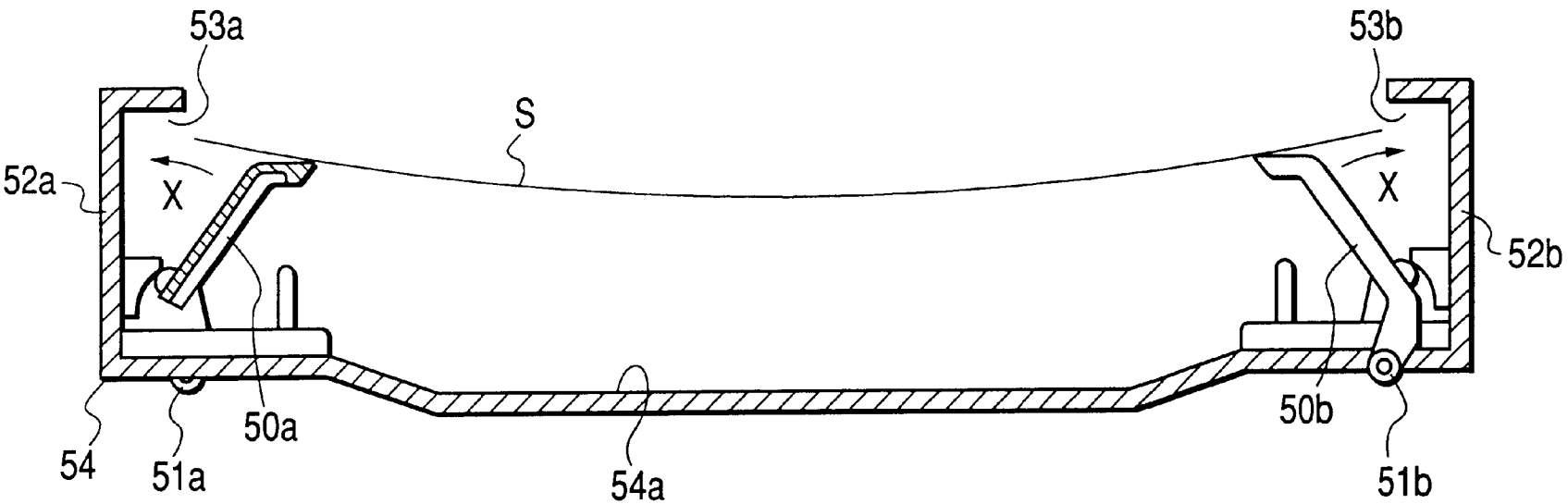
FIG. 11 is an explanatory view for explaining a conventional technique.

Incidentally, the drive transmitting arrangement according to the present invention can be used to open and close the side rails 50*a*, 50*b* of the conventional apparatus shown in FIG. 11.

What is claimed is:

1. An image forming apparatus comprising:

recording means for recording an image on a sheet and having a carriage shiftable in a sheet width-wise direction;

rotary conveying means for conveying the sheet through said recording means and for discharging the sheet after recording, said rotary conveying means comprising a discharge roller disposed downstream of said recording means;

support means for supporting one surface of the discharging sheet;

shift means for shifting said support means between a support position to support the discharging sheet above a discharge portion and a retreat position not to support the sheet by said support means; and transmission means for transmitting a driving force, for rotating said rotary conveying means, to said shift means, said transmission means comprising a fixed gear fixed in an axial direction and a slidable gear capable of being shifted in the axial direction by said carriage to be engaged with and disengaged from said fixed gear, wherein, when said carriage is positioned at a predetermined position, said slidable gear is engaged with said fixed gear to transmit the driving force to said shift means so that said support means is shifted to the retreat position, and when said carriage is separated from the predetermined position, said slidable gear is disengaged from said fixed gear to release said shift means so that said support means is shifted to the support position by an elastic force.

2. An image forming apparatus according to claim 1, further comprising drive means for shifting said carriage in the sheet width-wise direction.

3. An image forming apparatus comprising:

recording means for recording an image on a sheet and having a carriage shiftable in a sheet width-wise direction;

rotary conveying means for conveying the sheet through said recording means and for discharging the sheet after recording;

support means for supporting one surface of the discharging sheet;

shift means for shifting said support means between a support position to support the discharging sheet above a discharge portion and a retreat position not to support the sheet by said support means, wherein said shift means is switched in accordance with a position of said carriage and has transmission means for effecting ON/OFF of a driving force for rotating said rotary conveying means;

a first gear train rotated by a rotational force from said rotary conveying means, a second gear train rotated by rotation of said first gear train to rotate a supply rotary member disposed upstream of said rotary conveying means; and switch means for controlling engagement and disengagement between said first and second gear trains, wherein said switch means is brought to a connection permitting condition when said carriage is positioned at a record start position opposite to a predetermined position and is brought to a connection prohibiting condition when said carriage leaves said record start position.

4. An image forming apparatus according to claim 1, wherein said rotary conveying means further comprises a conveying roller disposed upstream of said recording means.

5. An image forming apparatus according to claim 4, wherein said discharge roller is rotated by a rotational force of said conveying roller.

6. An image forming apparatus according to claim 3, wherein said switch means includes a planetary gear.

7. An image forming apparatus comprising:

recording means for recording an image on a sheet and having a carriage shiftable in a sheet width-wise direction;

rotary conveying means for conveying the sheet through said recording means and for discharging the sheet after recording;

support means for supporting one surface of the discharging sheet; and shift means for shifting said support means between a support position to support the discharging sheet above a discharge portion and a retreat position not to support the sheet by said support means, wherein said shift means is switched in accordance with a position of said carriage and has transmission means for effecting ON/OFF of a driving force for rotating said rotary conveying means, wherein said transmission means is brought to a transmission permitting condition when said carriage exceeds a predetermined position to permit transmission of the driving force for said rotary conveying means to said shift means, thereby shifting said support means to the retreat position, and wherein, after the sheet is discharged, said carriage is shifted to the predetermined position exceeding one-line recording finish position, and drive means for said rotary conveying means is rotated to obtain a driving force.

8. An image forming apparatus comprising:

recording means for recording an image on a sheet and having a carriage shiftable in a sheet width-wise direction;

rotary conveying means for conveying the sheet through said recording means;

support means movable between a support position to support the sheet on which an image is recorded by said recording means and a retreat position not to support the sheet;

a spring for biasing said support means to the support position;

shift means for shifting said support means from the support position to the retreat position;

a motor for driving said rotary conveying means;

transmission means for transmitting a driving force of said motor to said shift means to shift said support means to the retreat position, said transmission means comprising a pair of gears; and switch means for bringing said pair of gears to a meshed condition when said carriage moves to a predetermined position, wherein, when said carriage is separated from the predetermined position, said transmission means does not transmit the driving force so that said spring regulates the position of said support means to the support position, and when said carriage moves to the predetermined position, said switch means brings said pair of gears to the meshed condition to transmit the driving force to said shift means.

9. An image forming apparatus according to any one of claims 1–8, wherein said support means can be shifted between the support position and the retreat position by rotating about an axis transverse to a sheet discharging direction.

10. An image forming apparatus according to one of claims 1–8, wherein said support means supports the discharging sheet while curving the sheet in a convex or concave manner in the sheet width-wise direction along a sheet conveying direction.

11. An image forming apparatus according to one of claims 1–8, wherein said support means includes a plurality of ribs for supporting the discharging sheet while curving the sheet in a convex or concave manner.

12. An image forming apparatus according to one of claims 1–8, wherein one surface of the discharging sheet supported by said support means is a rear surface opposite to a front surface on which the image is recorded by said recording means.

13. An image forming apparatus according to one of claims 1–8, wherein said recording means is of an ink jet recording system in which the recording is effected by discharging ink in response to a signal.

14. An image forming apparatus according to claim 13, wherein said recording means discharges ink from a discharge opening by utilizing film-boiling of the ink caused by thermal energy generated by an electrical/thermal converter.

* * * * *